US007313879B2

(12) United States Patent
Ward

(10) Patent No.: US 7,313,879 B2
(45) Date of Patent: Jan. 1, 2008

(54) SLIP PROOF PROTECTIVE HOLDER FOR SHEET MATERIAL

(76) Inventor: Robin L. Ward, 2233 Rte 102 Highway, Lincoln, New Brunswick (CA) E3B 8N9

( * ) Notice: Subject to any disclaimer, the term of this patent is extended or adjusted under 35 U.S.C. 154(b) by 0 days.

(21) Appl. No.: 11/403,071

(22) Filed: Apr. 12, 2006

(65) Prior Publication Data

US 2006/0230662 A1 Oct. 19, 2006

Related U.S. Application Data

(60) Provisional application No. 60/672,164, filed on Apr. 15, 2005.

(51) Int. Cl.

| | |
|---|---|
| ***A47G 1/06*** | (2006.01) |
| ***G09F 3/20*** | (2006.01) |
| ***G09F 3/18*** | (2006.01) |
| ***B65D 27/10*** | (2006.01) |
| ***B65D 69/00*** | (2006.01) |
| ***B65D 30/22*** | (2006.01) |

(52) U.S. Cl. ..... 40/771; 40/654.01; 40/775; 40/776; 229/69; 206/227; 383/38

(58) Field of Classification Search ..... 40/771, 40/775, 776, 654.01, 537, 661.01, 777, 661; 383/64, 63, 78, 88, 106; 402/79; 353/120; 156/211, 73.1; 281/29; 206/445
See application file for complete search history.

(56) References Cited

U.S. PATENT DOCUMENTS

| | | | | |
|---|---|---|---|---|
| 2,675,957 | A * | 4/1954 | Zimmerman | 383/35 |
| 3,884,412 | A * | 5/1975 | Price | 229/69 |
| 4,231,174 | A | 11/1980 | Thompson | |
| 4,958,450 | A | 9/1990 | Roberg | |
| 5,323,553 | A | 6/1994 | Candido | |
| 6,012,844 | A * | 1/2000 | Huseman et al. | 383/93 |
| 6,282,826 | B1 * | 9/2001 | Richards | 40/654.01 |
| 6,398,412 | B2 * | 6/2002 | Wedi et al. | 383/211 |
| 6,575,627 | B2 * | 6/2003 | Huseman et al. | 383/38 |
| 7,048,442 | B2 * | 5/2006 | Schneider et al. | 383/61.2 |
| 2005/0268507 | A1 * | 12/2005 | Valiulis et al. | 40/651 |

* cited by examiner

*Primary Examiner*—Lesley D. Morris
*Assistant Examiner*—Syed A Islam
(74) *Attorney, Agent, or Firm*—James Ray & Assoc.

(57) ABSTRACT

A protective holder for displaying a generally thin article includes a first member formed from a translucent material and a second member which is permanently attached to the first member to form a pocket open along one edge of at least one of the first member and the second member for receiving such generally thin article. A flap is hingedly attached to the edge of the first member and movable into a position internal to the pocket for securing such generally thin article, wherein a portion of such generally thin article is caged between the flap and the first member and is further movable into a position external to the pocket for one of insertion and removal of such generally thin article.

10 Claims, 1 Drawing Sheet

SLIP PROOF PROTECTIVE HOLDER FOR SHEET MATERIAL

CROSS-REFERENCE TO RELATED APPLICATIONS

This application is related to and claims priority from Provisional Patent Application Ser. No. 60/672,164 filed Apr. 15, 2005.

FIELD OF THE INVENTION

The present invention relates, in general, to a device for holding and protecting generally thin articles and, more particularly, this invention relates to a protective holder for storing and displaying generally thin articles in a slip proof fashion.

BACKGROUND OF THE INVENTION

As is generally well known, protective holders made from thin translucent plastic and containing a pocket, or a plurality of pockets, are used for storing generally thin articles of sheet material, such as papers, scrapbook pages, cards, photographs, and the like. It is further known that such pocket must be provided with a closure means for preventing such article from dislodging, or falling out, yet allowing such article to be easily inserted and removed from the pocket.

It is also desirable to store such article in a manner that allows an unobstructed view of its entire surface. U.S. Pat. No. 6,282,826 to Richards, U.S. Pat. No. 4,958,450 to Roberg and U.S. Pat. No. 4,231,174 to Thompson disclose various pocket closure types.

SUMMARY OF THE INVENTION

According to one embodiment, the present invention provides a device for storing, protecting and displaying a generally thin article of sheet material. The device includes a first member formed from material which is at least translucent. A second member is permanently attached to the first member to form a pocket open along one edge of at least one of the first member and the second member for receiving such generally thin article. A flap is hingedly attached to the edge of the first member. The flap is movable into a position internal to the pocket for securing such generally thin article, wherein a portion of such generally thin article is caged between the flap and the first member. The flap is further movable into a position external to the pocket for one of insertion and removal of such generally thin article.

According to another embodiment of the invention, there is provided a device for at least one of storing, protecting and displaying a plurality of generally thin articles of sheet material. Such device includes a first member formed from a material that is at least translucent. A second member is permanently attached to the first member to form a plurality of pockets. Each pocket has an open edge formed by a pair of edge portions of the first member and the second member. Each pocket is adapted to receive one of such plurality of generally thin articles. There is a plurality of flaps with each flap hingedly attached to a respective pocket at an edge portion of the first member. The flap is movable into a position internal to its respective pocket for securing such one of such plurality of generally thin articles by way of caging a portion thereof between the flap and the first member. The flap is further movable into a position external to its respective pocket for one of insertion and removal of such one of such plurality of generally thin articles.

According to yet another embodiment, the invention provides a device for at least one of storing, protecting and displaying a generally thin article of sheet material. The device includes a first member formed from a material which is at least translucent and a second member which is permanently attached to the first member to form at least one pocket open along one edge of at least one of the first member and the second member for receiving such generally thin article. A securing means is attached to at least one of the first member and the second member and positioned substantially within the at least one pocket for securing such generally thin article therein, the securing means is one of an adhesive and a hook and loop fastener.

OBJECTS OF THE INVENTION

It is, therefore, one of the primary objects of the present invention to provide a protective holder for storing, protecting and displaying a generally thin article of sheet material.

Another object of the present invention is to provide a protective holder which prevents such generally thin article from dislodging or falling out.

Yet another object of the present invention is to provide a protective holder which allows unobstructed view of such generally thin article.

A further object of the present invention is to provide a protective holder which allows for closure of the pocket containing such generally thin article.

Yet a further object of the present invention is to provide a protective holder which is capable of securely storing and displaying a pair of generally thin articles of sheet material.

An additional object of the present invention is to provide a protective holder which is inexpensive to manufacture.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
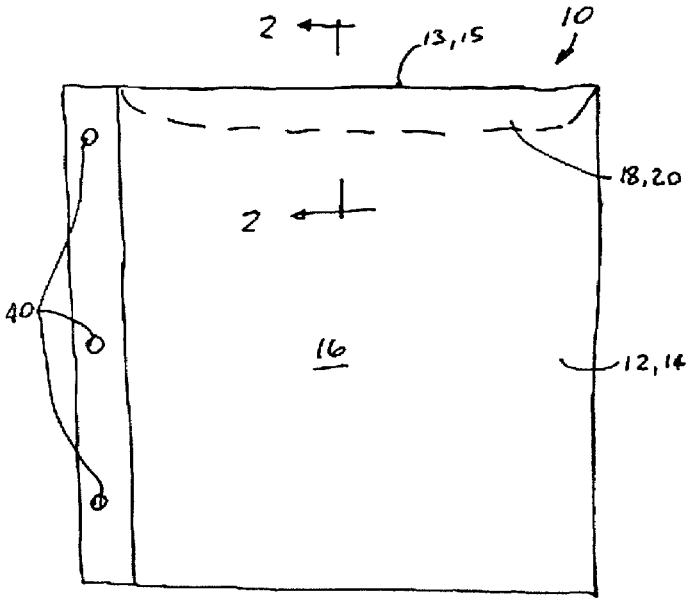
FIG. 1 is a front elevation view of a protective holder for a generally thin article of sheet material according to one embodiment of the present invention.

Prior to proceeding to the more detailed description of the present invention, it should be noted that, for the sake of clarity and understanding, identical components which have identical functions have been identified with identical reference numerals throughout the several views illustrated in the drawing figures.

It is to be understood that the definition of a generally thin article includes but is not limited to a sheet, scrapbook page, card, sports trading card, photograph and the like.

Figure 2A:
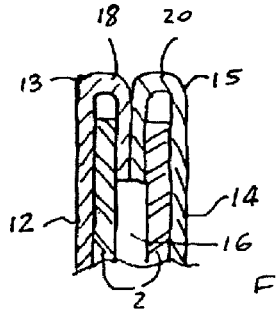
FIG. 2*a* is a partial cross-sectional view of the protective holder taken along the lines 2-2 of FIG. 1 showing such generally thin article in a stored and secured position.
Figure 2B:
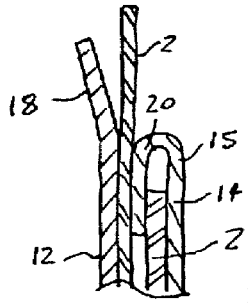
FIG. 2*b* is a partial cross-sectional view of the protective holder taken along the lines 2-2 of FIG. 1 showing the generally thin article in a partially removed position.
Figure 2C:
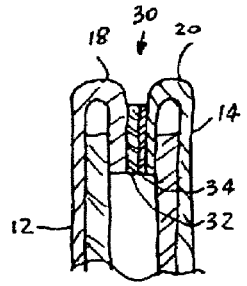
FIG. 2*c* is a partial cross-sectional view of the protective holder taken along the lines 2-2 of FIG. 1 showing a closure means of one embodiment of the invention.
Figure 3:
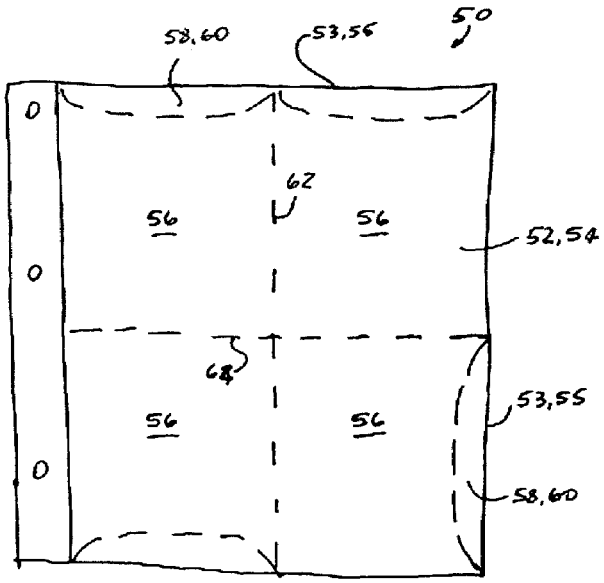
FIG. 3 is a front elevation view of a protective holder for a plurality of generally thin articles of sheet material according to another embodiment of the present invention.

Now in reference to FIGS. 1-3, where there is shown a device, generally designated 10, for at least one of storing, protecting and displaying a generally thin article 2 made from a sheet material. The device 10 includes a first member 12 formed from a translucent material, when such generally thin article 2 is to be displayed, and a second member 14 which is permanently attached to the first member 12 to form a pocket 16. Pocket 16 is open along an edge 13 of at least the first member 12 and, preferably, is open along the edge 15 of the second member 14 for receiving such generally thin article 2. As is well known in the art, the first member 12 is made from a thin sheet of plastic material.

In reference to FIGS. 2*a*-2*b*, a flap 18 is hingedly attached to the edge 13 of the first member 12. Preferably, the flap 18 extends along the entire width of such edge 13. The flap 18 is movable into a position internal to the pocket 16 for securing such generally thin article 2, wherein a portion of such generally thin article 2 is caged between the flap 18 and the first member 12.

The flap 18 is further movable into a position external to the pocket 16 for one of insertion and removal of such generally thin article 2. In such arrangement, the flap 18 allows unobstructed view of the generally thin article 2 while storing it within the pocket 16 in a slip proof fashion. The flap 18 further enables ease of insertion and removal of such generally thin article 2.

The second member 14 may also be formed from a translucent material for displaying both surfaces of the generally thin article 2 or for displaying a second generally thin article 2 stored within the pocket 16. An edge 15 of the second member 12 will then be preferably aligned with the edge 13 of the first member 12.

When a second generally thin article 2 is to be stored within the pocket 16, the device 10 includes a second flap 20 hingedly attached to the edge 15 of the second member 14 and which is operable in a manner described above with regards to the flap 18.

The device 10 may further include means, generally designated 30, which is attached to at least one of the flap 18 and the second flap 20 for closing the pocket 16 when such pair of generally thin articles 2 are received therein.

In reference to FIG. 2*c*, such closure means 30 is an adhesive 32 and the device 10 further includes a liner 34 covering the adhesive 32. In use, the liner 34 is removed for exposing the adhesive 32 to contact an opposed one of the flap 18 and the second flap 20 after such pair of generally thin articles 2 are positioned within the pocket 16. The contact will close the pocket 16 and secure the generally thin articles 2 therein.

Figure 2D:
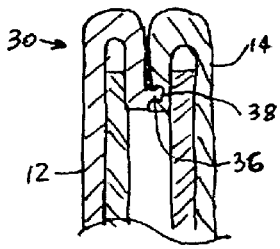
FIG. 2*d* is a partial cross-sectional view of the protective holder taken along the lines 2-2 of FIG. 1 showing a closure means of another embodiment of the invention.

In reference to FIG. 2*d*, such closure means 30 is a reclosable fastener 30, such as a plastic zipper, consisting of a male portion 36 and a female portion 38 which form a pair of continuous interlocking fastener elements. Alternatively, such reclosable fastener 30 may be a hook and loop fastener.

It will be understood, that when the device 10 includes only a single flap 18, such closure means 30 will be operable to connect the flap 18 to the second member 14. It will be further understood that such closure means 30, particularly of the adhesive or hook and loop type fastener may be provided for connecting the first member 12 directly to the second member 14.

The device 10 may further include a plurality of longitudinally aligned and spaced mounting apertures 40 to accommodate spaced rings of a ring-type binder (not shown).

Now in reference to FIG. 3, there is shown a device, generally designated 50, for at least one of storing, protecting and displaying a plurality of generally thin articles 2. The device 50 includes a first member 52 formed from a translucent material and a second member 54 which is permanently attached to the first member 12 to form a plurality of pockets 56 by way of longitudinal seals 64 and transverse seals 62. Each pocket has an open edge, formed by a pair of edge portions 53 and 55 of the first member 52 and the second member 54 respectively, for receiving one of such plurality of generally thin articles 2.

There is a plurality of flaps 58 provided for securing such one of such plurality of generally thin articles 2. Each flap 58 is hingeably attached to a respective pocket 56 at the edge portion 53 of the first member 52. The flap 58 is movable into a position internal to its respective pocket 56 for securing such one of such plurality of generally thin articles 2 by way of caging a portion thereof between the flap 58 and the first member 52. The flap 58 is movable into a position external to the pocket 56 for one of insertion and removal of such one of such plurality of generally thin articles 2.

When the second member 54 is also formed from a translucent material for displaying a second one of such plurality of generally thin articles 2, the device 50 also includes a plurality of second flaps 60 each hingedly attached to its respective pocket 56 at an edge portion 55 of second member 54 and operable identically to the flap 58.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A device for at least one of storing, protecting and displaying a generally thin article of sheet material, said device comprising:

(a) a first member having a predetermined size;

(b) a second member permanently attached to said first member to form a pocket open along one edge of at least one of said first member and said second member for receiving such generally thin article;

(c) a first flap hingeably attached to said one edge of said first member, said flap hingeably movable into a first position internal to said pocket for securing such generally thin article, wherein a portion of such generally thin article is caged between said flap and said first member, said flap hingeably movable into a second position external to said pocket for one of insertion and removal of such generally thin article;

(d) a second flap hingeably attached to said one edge of said second member, said flap movable into a third position internal to said pocket for securing a second generally thin article wherein a portion of such second generally thin article is caged between said second flap and said second member, said second flap movable into a forth position external to said pocket for one of insertion and removal of such second generally thin article.

2. The device, according to claim 1, wherein said first member is formed from a translucent material.

3. The device, according to claim 1, wherein said second member is formed from a translucent material and said one edge of said second member is aligned with said one edge of said first member.

4. The device, according to claim 1, wherein said device further includes a plurality of longitudinally aligned and spaced mounting apertures disposed adjacent one closed edge of said pocket.

5. The device, according to claim 1, wherein said device includes means attached to at least one of opposed surfaces of said first flap and said second flap for closing said pocket when said first flap and said second flap are moved respectively into said first and said third position internal to said pocket, said pocket closing means being one of an adhesive and a reclosable fastener.

6. The device, according to claim 5, wherein said reclosable fastener is one of a plastic zipper and a hook and loop fastener.

7. The device, according to claim 5, wherein said adhesive means is an adhesive tape.

8. The device, according to claim 7, wherein said device further includes a removable liner covering said adhesive tape prior to closing said pocket.

9. A device for at least one of storing, protecting and displaying a plurality of generally thin articles of sheet material, said device comprising:

(a) a first member having a predetermined size;

(b) a second member permanently attached to said first member to form a plurality of pockets by way of longitudinal and transverse seals, each pocket having an open edge formed by a pair of edge portions of said first member and said second member, said pocket provided for receiving one of such plurality of generally thin articles; and (c) a plurality of first flaps each formed integral with and hingeably attached to a respective pocket at an edge portion of said first member, said each first flap hingeably movable into a first position internal to said respective pocket for securing such one of such plurality of generally thin articles by way of caging a portion thereof between said each first flap and said first member, said each first flap hingeably movable into a second position external to said respective pocket for one of insertion and removal of such one of such plurality of generally thin articles (d) a plurality of second flaps each hingeably attached to said respective pocket at an edge portion of said second member, said each second flap movable into a third position internal to said respective pocket for securing a second one of such plurality of generally thin articles by way of caging a portion thereof between said second flap and said second member, said second flap movable into a forth position external to said pocket for one of insertion and removal of such second one of such plurality of generally thin articles.

10. The device, according to claim 9, wherein at least one of said first member and said second member is formed from a translucent material.

* * * * *